United States Patent [19]

Renaud

[11] 4,428,314

[45] Jan. 31, 1984

[54] NEEDLE GUIDE

[75] Inventor: Ronnie C. Renaud, Liberty, S.C.

[73] Assignee: Universal Sewing Supply Inc., St. Louis, Mo.

[21] Appl. No.: 281,002

[22] Filed: Jul. 6, 1981

[51] Int. Cl.[3] ..... D05B 55/06

[52] U.S. Cl. ..... 112/227

[58] Field of Search ..... 112/227, 261, 197, 199

[56] References Cited

U.S. PATENT DOCUMENTS

| | | | |
|---|---|---|---|
| 712,852 | 11/1902 | Rontke | 112/227 |
| 1,387,619 | 8/1921 | Rosenthal | 112/227 |
| 3,313,259 | 4/1967 | Daniel et al. | 112/227 X |
| 3,872,810 | 3/1975 | Johnson | 112/227 |

*Primary Examiner*—Werner H. Schroeder
*Assistant Examiner*—Andrew M. Falik
*Attorney, Agent, or Firm*—Sennigers, Powers, Leavitt and Roedel

[57] ABSTRACT

A needle guide for a buttonhole sewing machine provided with a pair of reciprocating loopers that in cooperation with a vertically reciprocating needle produce chain stitches for forming a buttonhole on a fabric. The needle guide include a pair of inner and outer surfaces defining a U-shaped member which is carried below the path of the reciprocating needle. A downwardly depending guide surface extends into the U-shaped member between the inner and outer surfaces. The outer surface is positioned on one side of the needle and the depending guide surface is positioned on the opposite side of the needle for restricting deflection of the needle from its desired path. The U-shaped member is positioned between the pair of loopers for permitting the loopers to reciprocate in and out of the U-shaped member from opposed sides during the buttonhole stitch forming operation.

1 Claim, 4 Drawing Figures

NEEDLE GUIDE

BACKGROUND OF THE INVENTION

One problem when sewing the stitches that surround a buttonhole on garments and the like on a buttonhole sewing machine is that oftentimes, the needle will be deflected as a result of the thickness of the fabric or the feeding of the fabric on the machine. This causes loopers associated with the buttonhole sewing machine mechanism to miss the thread extending through the eye of the needle, and as a result miss a stitch. This, in turn, causes flaws in the buttonholes.

Needle guides for sewing machines equipped with loopers have been proposed in the past, and one example of such a needle guide is disclosed in U.S. Pat. No. 1,276,393. In that particular device, there is a plurality of needles and a plurality of loopers for engaging the thread extending through the respective needles. Guides are positioned relative to the loopers and the normal path of the needles for preventing the needles from being deflected during sewing. As can be seen, such guides are quite complicated and as shown in the patent are used in conjunction with a plurality of loopers all of which are positioned on one side of the path of the needles. Other examples of guides for sewing machine needles are disclosed in U.S. Pat. Nos. 280,773 and 1,419,718.

SUMMARY OF THE INVENTION

This invention relates to a needle guide for use on a sewing machine provided with a pair of reciprocating loopers that in cooperation with a vertically reciprocating needle produce chain stitches that normally surround a buttonhole on a garment. The needle guide includes spaced inner and outer surfaces defining a U-shaped member that is carried by the machine below the path of the reciprocating needle so that on the downstroke of the needle the needle extends into an open top of the U-shaped member. A guide surface is carried within the U-shaped member on an opposite side of the needle from the outer surface. The guide surface and the outer surface converge towards each other in a direction away from the end of the needle for aiding in guiding the needle along a vertical path midway between the outer surface and the guide surface. The U-shaped member is open on the sides and is positioned between the pair of loopers for permitting the loopers to reciprocate in and out of the U-shaped member from opposed sides for engaging the thread extending through the eye of the needle for forming the stitches of the buttonhole.

Accordingly, it is an important object of the present invention to provide a needle guide for use on a buttonhole sewing machine.

Another important object of the present invention is to provide a needle guide that cooperates with a pair of alternating reciprocating loopers forming part of a buttonhole sewing machine to insure that the needle is properly positioned relative to the loopers during the stitching operation.

These and other objects of the invention will become more apparent upon reading of the following specification and drawings wherein:

DESCRIPTION OF A PREFERRED EMBODIMENT

Figure 2:
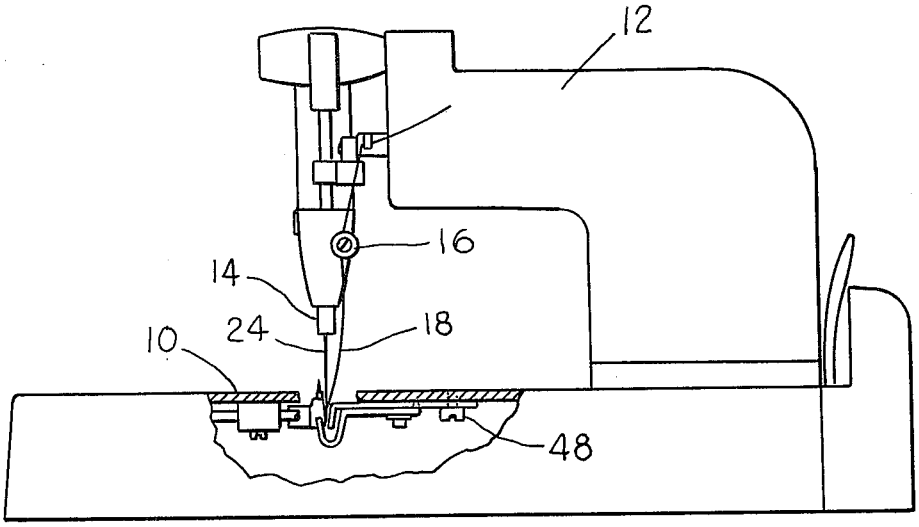
FIG. 2 is a side elevational view showing the needle guide positioned on a buttonhole sewing machine.
Figure 3:
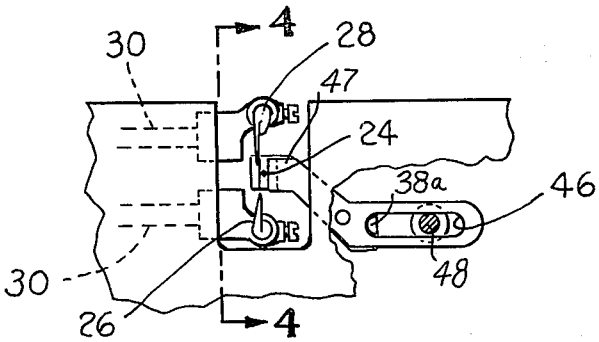
FIG. 3 is a plan view showing the location of the needle guide relative to the pair of loopers forming part of the buttonhole stitching machine.
Figure 1:
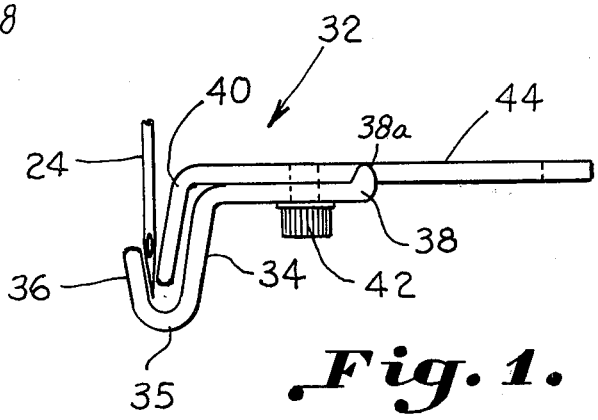
FIG. 1 is a side elevational view illustrating a needle guide constructed in accordance with the present invention.
Figure 4:
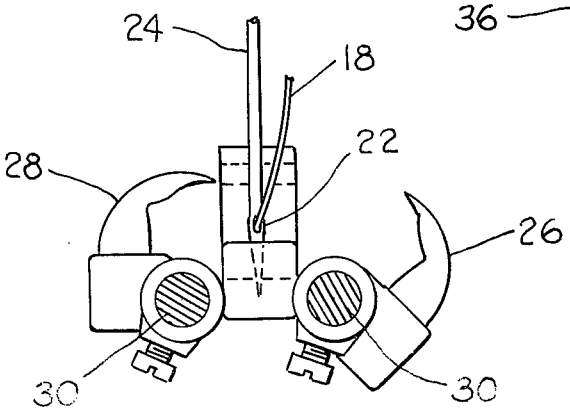
FIG. 4 is an enlarged sectional view taken along line 4—4 of FIG. 3.

Referring to FIG. 2 of the drawing, there is illustrated a conventional buttonhole sewing machine that includes a base plate 10 which supports the fabric that the buttonholes are to be sewed therein. Extending over the base plate is a standard 12 which has extending downwardly therefrom a needle bar 14 which supports the needle and causes it to reciprocate up and down in a vertical path during the stitching operation. The sewing machine is equipped with a conventional thread tensioner 16 through which the thread 18 passes on its way down through an eye 22 of a needle 24. Positioned on opposite sides of the needle 24 is a pair of loopers 26 and 28 which alternately engage the thread passing through the eye of the needle 20 on alternate strokes of the needle for forming the stitches in the fabric. The loopers 26 and 28 are, in turn, supported on conventional looper rods 30. Up to this point in the detailed description of the invention, all of the elements described relative to the sewing machine are conventional to buttonhole sewing machines. If the needle 24 is deflected from its normal vertical path, then the loopers 26 and 28 may miss the thread and cause a misstitch. Furthermore, if the needle is deflected it will oftentimes cause the loopers 26 and 28 to strike the needle wearing the tip of the loopers and the needle and some times breaking the needle.

In order to insure that the needle travels on a true vertical path on each stroke, a needle guide, generally designated by the reference character 32, is positioned below the bed plate. The needle guide includes spaced inner and outer surfaces 34 and 36, respectively, joined by a bottom in the form of a U-shaped member 35. The upper end of the inner surface terminates in a horizontal plane 38. A downwardly depending guide surface 40 extends into the U-shaped member between the inner and outer surfaces 34 and 36 and terminates adjacent its bottom on a side of the normal path of the needle opposite from that of the outer surface 36. A bolt 42 extends through an oversize hole provided in the horizontal portion 38 of the flange so that the U-shaped member can be adjusted relative to the guide surface 40. It is noted that the guide surface 40 also terminates in a horizontal flange 44 into which the bolt 42 is secured. A slot 46 is provided in the horizontal flange portion 44 for receiving another bolt 48 which screws in the bottom side of the bed plate 10. Also extending into the slot 46 is a vertically post 38*a* carried on the end of horizontal portion 38 which aids in positioning the U-shaped member 35.

As can be seen, the horizontal portion 47 of the depending guide surface 40 is dog-legged so as to positon the U-shaped member midway between the loopers 26 and 28 and directly beneath the normal path of the needle 24. As a result of the sides of the U-shaped member 35 being open, the loopers are permitted to alternately reciprocated in and out of the U-shaped member for engaging the thread extending through the eye 22 of the needle on alternate strokes for forming the stitch.

When setting up the guide, first the horizontal member 44 attached to depending guide surface 40 is positioned by means of screw 48 so that the bottom edge of the guide surface 40 is approximately 0.001 of an inch from the normal path of the needle. After this has been set, then the screw 42 is used to adjust the position of the U-shaped member so that the inner wall of the outer surface 36 is 0.001 of an inch from the opposite side of the needle. As a result, if the needle tends to be deflected by thick fabric or by the feed of the cloth, it will engage either the depending guide surface 40 or the outer surface 36 insuring that it is not deflected and is properly positioned for the loopers 26 and 28 to engage the thread extending therethrough.

While a preferred embodiment of the invention has been described using specific terms, such description is for illustrative purposes only, and it is to be understood that changes and variations may be made without departing from the spirit or scope of the following claims.

What is claimed is:

1. A sewing machine which includes a needle guide and a reciprocating looper which in cooperation with a reciprocating needle forms stitches in a fabric being sewn on the sewing machine wherein said needle guide comprises:

a horizontally extending elongated member;

a downwardly depending guide surface carried adjacent one end of said elongated member;

an elongated slot provided in said elongated member;

spaced vertically inclined inner and outer surfaces joined at a lower end to define a "U" shaped member;

a horizontal leg integral with an upper end of said inner surface;

a vertically extending positioning post carried on an end of said horizontal leg;

a bolt means for adjustably connecting said horizontal leg to said elongated member with said positioning post extending into said slot provided in said elongated member and said downwardly depending guide surface extending in between said inner and outer surfaces so that the spacing between said depending guide and said outer leg can be adjusted to accommodate needles of different sizes.

* * * * *